US006536369B1

(12) United States Patent
Bent et al.

(10) Patent No.: US 6,536,369 B1
(45) Date of Patent: Mar. 25, 2003

(54) HANDLE FOR TRAFFIC DELINEATOR

(75) Inventors: Bruce C. Bent, Huntington Beach, CA (US); James A. Bent, Huntington Beach, CA (US)

(73) Assignee: Bent Manufacturing Company, Huntington Beach, CA (US)

( * ) Notice: Subject to any disclaimer, the term of this patent is extended or adjusted under 35 U.S.C. 154(b) by 116 days.

(21) Appl. No.: 09/642,124

(22) Filed: Aug. 18, 2000

(51) Int. Cl.[7] ..... E01F 9/012; G09F 17/00

(52) U.S. Cl. ..... 116/63 P; 404/9; 116/173

(58) Field of Search ..... 116/63 R, 63 P, 116/63 C, 173; 404/9 XF; 40/612; 256/1, 59, 65; D10/104–121; D11/166, 182

(56) References Cited

U.S. PATENT DOCUMENTS

| | | | | | |
|---|---|---|---|---|---|
| 196,889 | A | | 11/1877 | Gillham | |
| 1,228,615 | A | | 6/1917 | Stafford | |
| D60,293 | S | | 1/1922 | Meden | |
| 1,939,968 | A | | 12/1933 | Frei | 189/23 |
| 2,103,410 | A | | 12/1937 | Frei | 189/23 |
| 2,378,750 | A | | 6/1945 | Carew | 229/1.5 |
| 2,448,413 | A | | 8/1948 | Borghesi | 248/194 |
| 2,456,685 | A | | 12/1948 | Delmotte | 177/329 |
| 2,483,734 | A | | 10/1949 | Neal | 40/125 |
| 2,557,859 | A | * | 6/1951 | Bernstein | 116/173 |
| 2,564,145 | A | | 8/1951 | Beall et al. | 177/329 |
| 2,628,587 | A | | 2/1953 | Peters et al. | 116/63 |
| 2,649,803 | A | | 8/1953 | Andre | 46/25 |
| 2,762,327 | A | | 9/1956 | Weig | 116/63 |
| 2,762,328 | A | | 9/1956 | Weig | 116/63 |
| 2,808,803 | A | | 10/1957 | Weig | 116/63 |
| 2,817,308 | A | | 12/1957 | Scanlon | 116/63 |
| 2,843,347 | A | | 7/1958 | King | 248/44 |
| 2,942,571 | A | | 6/1960 | White | 116/63 |
| 2,957,444 | A | | 10/1960 | Boettler | 116/63 |
| 2,977,864 | A | | 4/1961 | Pullar | 94/22 |

(List continued on next page.)

FOREIGN PATENT DOCUMENTS

| | | | |
|---|---|---|---|
| AU | 216329 | 6/1956 | 116/63 |
| DE | 2 233 994 | 2/1974 | |
| FR | 2 580 050 | 10/1986 | |
| GB | 665785 | 1/1952 | 116/63 |
| GB | 1058881 | 2/1967 | |
| GB | 1 301 084 | 12/1972 | |
| GB | 2 077 332 | 5/1981 | |
| GB | 2 090 313 | 12/1981 | |
| GB | 2 081 348 | 2/1982 | |
| GB | 2 101 180 | 1/1983 | |
| GB | 2 122 239 | 5/1983 | |
| GB | 2 156 409 | 3/1984 | |
| GB | 2 182 701 | 10/1986 | |

OTHER PUBLICATIONS

Safety Cade Barricades, WLI Industries; Addison, IL 60101 (Prior to 1991).*

Flasher Flare, South East, Inc.; Hillsborough County, FL (Oct. 17, 1991).*

Safety Devices, Traffic Safety Service Corp.; South Plainfield, NJ 07080 (Oct. 17, 1991).*

Plasticades, Narrowcades, Minicades, etc., Best Barricade; Rolling Meadows, IL 60008 (Prior to 1992).*

*Primary Examiner*—Diego Gutierrez
*Assistant Examiner*—Tania C. Courson
(74) *Attorney, Agent, or Firm*—J. Harrison Colter

(57) ABSTRACT

A handle for the top of a blow-molded traffic delineator includes a bulbous lower portion, an curved intermediate portion, and an upper portion that forms a T-shaped handle. The upper portion has a hole therethrough to allow mounting of a warning light or other item. The intermediate portion has a curvature that gradually reduces the diameter of the handle moving from lower end to upper end, in a shape that easily accommodates the grasp of a human hand.

13 Claims, 4 Drawing Sheets

U.S. PATENT DOCUMENTS

| | | | | | |
|---|---|---|---|---|---|
| 3,099,244 | A | | 7/1963 | Knapp | 116/63 |
| 3,119,588 | A | | 1/1964 | Keats | 248/158 |
| 3,231,994 | A | | 2/1966 | Cyrus | 40/125 |
| 3,380,428 | A | | 4/1968 | Abrams | 116/63 |
| 3,451,368 | A | | 6/1969 | Keats | 116/63 |
| 3,471,114 | A | | 10/1969 | Ball | 248/346 |
| 3,499,413 | A | | 3/1970 | Heard | 116/63 |
| 3,520,235 | A | | 7/1970 | Palazzolo | 94/1.5 |
| 3,563,445 | A | | 2/1971 | Fairport | 229/25 |
| 3,591,144 | A | | 7/1971 | Iving | 256/13.1 |
| 3,618,556 | A | | 11/1971 | Dittrich | 116/63 |
| 3,619,443 | A | | 11/1971 | Feldman | 264/89 |
| 3,644,618 | A | | 2/1972 | Krueger | 248/44 |
| 3,660,817 | A | | 5/1972 | Abrams | 340/114 |
| 3,664,085 | A | | 5/1972 | Rousseau et al. | 53/112 |
| 3,675,811 | A | | 7/1972 | Artz | 220/20 |
| 3,701,456 | A | | 10/1972 | Alroy | 220/97 |
| 3,732,842 | A | | 5/1973 | Vara, Sr. | 116/63 |
| 3,738,309 | A | | 6/1973 | Nichol | 116/63 |
| 3,751,852 | A | | 8/1973 | Schrepper | 47/34 |
| 3,794,090 | A | | 2/1974 | Commisso | 150/0.05 |
| 3,809,007 | A | | 5/1974 | Brown | 116/63 |
| 3,822,668 | A | | 7/1974 | Schradieck | 116/63 |
| 3,825,114 | A | | 7/1974 | Johnson et al. | 206/507 |
| 3,846,935 | A | | 11/1974 | Wagner | 47/26 |
| D235,744 | S | | 7/1975 | England | D10/109 |
| 3,913,518 | A | | 10/1975 | Kaplan | 116/63 |
| 3,916,816 | A | | 11/1975 | Fitch | 116/63 |
| 3,949,701 | A | | 4/1976 | Teixeira | 116/63 |
| 3,950,208 | A | | 4/1976 | Pavuk et al. | 264/156 |
| 3,952,690 | A | | 4/1976 | Rizzo et al. | 116/63 |
| D243,073 | S | | 1/1977 | Kulp et al. | D10/109 |
| D243,074 | S | | 1/1977 | Kulp et al. | D10/109 |
| D243,075 | S | | 1/1977 | Kulp et al. | D10/109 |
| 4,006,702 | A | | 2/1977 | St. Cyr | 116/63 |
| 4,007,919 | A | | 2/1977 | Totten | 256/59 |
| 4,019,271 | A | | 4/1977 | Latimer | 40/125 |
| 4,026,086 | A | | 5/1977 | Langley | 52/582 |
| 4,040,759 | A | | 8/1977 | Skalle | 404/6 |
| 4,053,100 | A | | 10/1977 | Baptist | 229/43 |
| 4,054,207 | A | | 10/1977 | Lazure et al. | 206/486 |
| 4,071,224 | A | | 1/1978 | Gilbert | 256/64 |
| 4,083,033 | A | | 4/1978 | Kulp et al. | 340/114 |
| 4,091,497 | A | * | 5/1978 | Bade | 16/110 R |
| 4,102,453 | A | | 7/1978 | Carroll et al. | 206/507 |
| 4,102,454 | A | | 7/1978 | Karevaara | 206/514 |
| 4,120,398 | A | | 10/1978 | Braddon et al. | 206/408 |
| 4,134,533 | A | | 1/1979 | Heavner | 229/34 |
| 4,145,044 | A | | 3/1979 | Wilson et al. | 273/1.5 R |
| 4,175,661 | A | | 11/1979 | Barnes | 206/519 |
| 4,184,604 | A | | 1/1980 | Amberg et al. | 220/254 |
| 4,187,647 | A | | 2/1980 | Hall | 52/20 |
| 4,188,151 | A | | 2/1980 | Hall | 404/26 |
| 4,197,808 | A | | 4/1980 | Kinninger | 116/63 |
| 4,201,975 | A | | 5/1980 | Marcus | 340/84 |
| 4,239,137 | A | | 12/1980 | Arcoutte | 224/319 |
| 4,256,050 | A | | 3/1981 | Barnard | 116/63 |
| 4,289,419 | A | | 9/1981 | Young et al. | 404/6 |
| 4,291,830 | A | | 9/1981 | Sorensen | 229/45 R |
| 4,298,186 | A | | 11/1981 | Glass | 256/64 |
| 4,303,349 | A | | 12/1981 | Upton | 404/6 |
| 4,312,600 | A | | 1/1982 | Schaaf et al. | 404/6 |
| 4,317,617 | A | | 3/1982 | Charlton | 350/97 |
| 4,329,800 | A | | 5/1982 | Shuman | 40/606 |
| 4,334,616 | A | | 6/1982 | Wilson | 206/505 |
| 4,348,133 | A | | 9/1982 | Trent et al. | 404/6 |
| 4,349,147 | A | | 9/1982 | Jensen | 229/34 |
| 4,412,644 | A | | 11/1983 | La Fever | 229/1.5 |
| 4,418,863 | A | | 12/1983 | Kimbrell, Sr. | 229/49 |
| D272,809 | S | | 2/1984 | Bent et al. | D10/109 |
| 4,441,600 | A | | 4/1984 | Caray | 192/89 B |
| 4,441,615 | A | | 4/1984 | Goodrich | 206/511 |
| 4,466,376 | A | | 8/1984 | Wells | 116/63 |
| 4,475,101 | A | | 10/1984 | Kulp et al. | 340/114 |
| D276,510 | S | | 11/1984 | Bent et al. | D10/109 |
| 4,511,281 | A | | 4/1985 | Schmanski | 404/10 |
| 4,516,109 | A | | 5/1985 | Thurston | 340/114 |
| D279,275 | S | | 6/1985 | Cory | D10/109 |
| 4,520,928 | A | | 6/1985 | Wilson | 206/505 |
| 4,570,798 | A | | 2/1986 | Wilson | 206/505 |
| 4,573,109 | A | | 2/1986 | Lack | 362/194 |
| 4,596,489 | A | | 6/1986 | Mariol et al. | 404/10 |
| 4,611,949 | A | | 9/1986 | Schmanski | 404/9 |
| 4,624,210 | A | | 11/1986 | Glass | 116/63 |
| 4,674,431 | A | | 6/1987 | Cory | 116/63 |
| 4,688,766 | A | | 8/1987 | Zucker | 256/13.1 |
| 4,710,053 | A | | 12/1987 | Kulp et al. | 404/9 |
| 4,772,869 | A | | 9/1988 | Grammas et al. | 340/114 |
| 4,782,783 | A | | 11/1988 | Kulp et al. | 116/63 |
| 4,792,258 | A | | 12/1988 | Goff | 404/6 |
| 4,798,017 | A | | 1/1989 | Giotis | 40/612 |
| 4,846,025 | A | * | 7/1989 | Keller et al. | 81/3.09 |
| 4,852,511 | A | | 8/1989 | Look et al. | 116/63 |
| 4,859,983 | A | | 8/1989 | Kulp et al. | 340/908.1 |
| 4,925,334 | A | | 5/1990 | Beard | 404/9 |
| D309,585 | S | | 7/1990 | Kulp | D10/109 |
| D310,642 | S | | 9/1990 | Kulp | D10/109 |
| 4,973,190 | A | | 11/1990 | Erwin et al. | 404/10 |
| 5,003,912 | A | | 4/1991 | Thurston | 116/63 |
| 5,009,541 | A | | 4/1991 | Thurston | 404/6 |
| 5,024,435 | A | | 6/1991 | Robbins | 273/26 |
| 5,026,204 | A | | 6/1991 | Kulp et al. | 404/10 |
| 5,036,791 | A | | 8/1991 | Thurston | 116/63 |
| D320,172 | S | | 9/1991 | Thurston | D10/113 |
| 5,046,885 | A | | 9/1991 | Thurston | 404/10 |
| 5,054,955 | A | | 10/1991 | Habernig | 404/10 |
| 5,103,616 | A | | 4/1992 | Nordberg | 52/585 |
| 5,161,783 | A | | 11/1992 | German | 256/19 |
| 5,165,818 | A | | 11/1992 | Newhart | 404/10 |
| 5,168,827 | A | | 12/1992 | Junker | 116/63 |
| 5,195,453 | A | | 3/1993 | McGibbon, II | 116/63 |
| 5,199,813 | A | | 4/1993 | Nagler | 404/9 |
| 5,199,814 | A | | 4/1993 | Clark et al. | 404/10 |
| 5,201,599 | A | | 4/1993 | Kulp et al. | 404/6 |
| 5,220,740 | A | | 6/1993 | Brault | 40/606 |
| 5,234,280 | A | | 8/1993 | Cowan | 404/6 |
| 5,287,822 | A | | 2/1994 | Anderson | 116/63 |
| 5,306,106 | A | | 4/1994 | Mileti | 404/6 |
| 5,354,031 | A | | 10/1994 | Bilotti | 248/519 |
| 5,387,049 | A | | 2/1995 | Duckett | 404/6 |
| 5,446,984 | A | | 9/1995 | Kulp et al. | 40/610 |
| 5,451,118 | A | | 9/1995 | Wilkins et al. | 404/6 |
| 5,458,434 | A | | 10/1995 | Bent et al. | 404/6 |
| 5,481,835 | A | | 1/1996 | Bloom | 52/98 |
| 5,482,270 | A | | 1/1996 | Smith | 273/72 |
| 5,484,225 | A | | 1/1996 | Warner | 404/9 |
| 5,540,007 | A | | 7/1996 | Kulp et al. | 40/610 |
| 5,560,732 | A | | 10/1996 | Kulp et al. | 404/10 |
| 5,568,784 | A | * | 10/1996 | Willis et al. | 116/173 |
| 5,577,824 | A | | 11/1996 | Wright | 340/908.1 |
| D386,705 | S | | 11/1997 | Morgan | D10/113 |
| 5,722,788 | A | | 3/1998 | Bent et al. | 404/6 |
| 5,735,632 | A | | 4/1998 | Braverman | 404/6 |
| 5,749,673 | A | | 5/1998 | Kulp et al. | 404/10 |
| 5,755,528 | A | | 5/1998 | Kulp et al. | 404/6 |
| 5,772,357 | A | | 6/1998 | Evans | 404/7 |
| 5,860,237 | A | | 1/1999 | Johnson | 40/603 |
| 5,868,520 | A | | 2/1999 | Kulp et al. | 404/6 |
| D406,543 | S | * | 3/1999 | Brown et al. | D10/113 |
| 5,899,167 | A | * | 5/1999 | Furmann | 116/173 |
| D412,131 | S | | 7/1999 | Bent et al. | D10/113 |

D415,443 S 10/1999 Bent et al. ..... D10/113
6,014,941 A 1/2000 Bent et al. ..... 116/63
6,019,542 A 2/2000 Bent et al. ..... 404/6
D427,289 S * 6/2000 Hundley ..... D23/250
D432,935 S * 10/2000 Bent et al. ..... D10/113
6,182,600 B1 * 2/2001 Brown et al. ..... 116/63
6,186,699 B1 * 2/2001 Kulp et al. ..... 404/10
6,305,312 B1 * 10/2001 Bent et al. ..... 166/63 P

* cited by examiner

HANDLE FOR TRAFFIC DELINEATOR

BACKGROUND OF THE INVENTION

This invention relates generally to traffic delineators, and more particularly to a handle formed in the top of a blow-molded cylindrical or conical traffic delineator.

The development of plastic traffic delineators, such as plastic cylinders, cones and barrels, for directing and channeling traffic flows has significantly increased the safety of automotive transportation. If a wood or metal delineator is struck by an automobile, the occupants may be seriously injured and the automobile seriously damaged. If a car being channeled by a line of plastic cylindrical delineators strikes one of the plastic cylinders, the lightweight, collapsible delineator causes little damage to the vehicle, which reduces the risk of injury to the vehicle occupants. Plastic cylinders are also sufficiently resilient to withstand numerous hits from vehicles and not show significant wear.

Plastic cylindrical traffic delineators have many advantages, including relative ease of manufacturing, light weight, and easy storage because the cylinders have a relatively narrow diameter and thus do not require significant space. Plastic conical traffic delineators have the same advantages and can also be stacked for storage. These delineators may be made of numerous colors, but a bright "flourescent" orange has become common. Such coloration makes the cylinders more easily seen, day or night and in good or bad weather, than other colors.

For ease of manufacture and use, cylindrical and conical delineators are often made in two pieces, a blow-molded cylinder or cone over which a drop down base is placed. The cylinder or cone is usually a light-weight structure having a thin, plastic wall. The drop down base may be made of lightweight plastic, but is often made of heavy rubber. Sandbags or other ballasting materials may be used to increase the weight of the base and cylinder or cone combination.

Recently, manufacturers have included handles on the top of the cylindrical and conical delineators to make it easier to move the delineators. One such handle is that on the cylindrical delineator being sold by Bent Manufacturing company of Huntington Beach, Calif. That handle has a modified "T" shape, with the upper surface of the handle having an arcuate curvature to fit into human hands. Another cylindrical delineator having a handle on top is depicted in U.S. Pat. No. 5,036,791 to Thurston, the disclosure of which is incorporated herein by this reference. That patent depicts two handles, one being of a generally "T" shape and the other having an inverted "U" shape. Yet another cylindrical delineator handle is that on the delineator being sold by Traffix Devices, Inc. of San Clemente, Calif. That handle is merely a reduction in the diameter of the cylinder, and then an abrupt enlargement of the diameter on the very top end of the cylinder, to form what may be termed as a "baseball bat" handle.

Existing handles formed on the top end of the cylinder have drawbacks. In particular, existing handles can be crushed when run over by an automobile. Generally, existing handles do not recover from such a crushing force, but rather are permanently deformed or require significant effort to push the plastic back into its original shape. Furthermore, existing handles are not as comfortable to hold as might be desired, and several of the prior handles do not accommodate attachment of a warning light or other marker to the top of the traffic delineator.

SUMMARY OF THE INVENTION

According to the present invention, handle for the top of a traffic delineator is provided that overcomes these and other drawbacks of the prior handles. A handle made according to the present invention is inexpensive to manufacture and incorporate into existing cylindrical or conical delineator designs. Thus, existing bases and molds may be used, with relatively minor modifications to incorporate the handle of the present invention.

The handle of the present invention includes a lower portion, and intermediate portion, and an upper portion. The lower portion seamlessly connects to the remainder of the delineator.

The intermediate portion is formed in the shape of a concave curve rotated about the axis of the cylindrical or conical delineator in such a fashion that the diameter of the intermediate portion gradually reduces from the lower end to the upper end. This shape renders the handle both very easily gripped by a human hand and also causes the handle to assume its original shape even after a crushing force such a car running over the handle.

The upper portion of the handle includes an extension beyond the reduced diameter of the intermediate section. This horizontal extension acts as a block to assist in holding the delineator by the intermediate portion. The extension may be similar to the T-shaped handles known in the art, or may be of the "baseball bat" shape.

The handle of the present invention may also include means for mounting a warning light to the top of the delineator. Thus, the present invention retains the advantages of prior delineator handles while providing additional advantages.

BRIEF DESCRIPTION OF THE DRAWINGS

Other features and advantages of the present invention will be apparent from the following Detailed Description taken in conjunction with the accompanying Drawings, in which.

DETAILED DESCRIPTION

Figure 1:
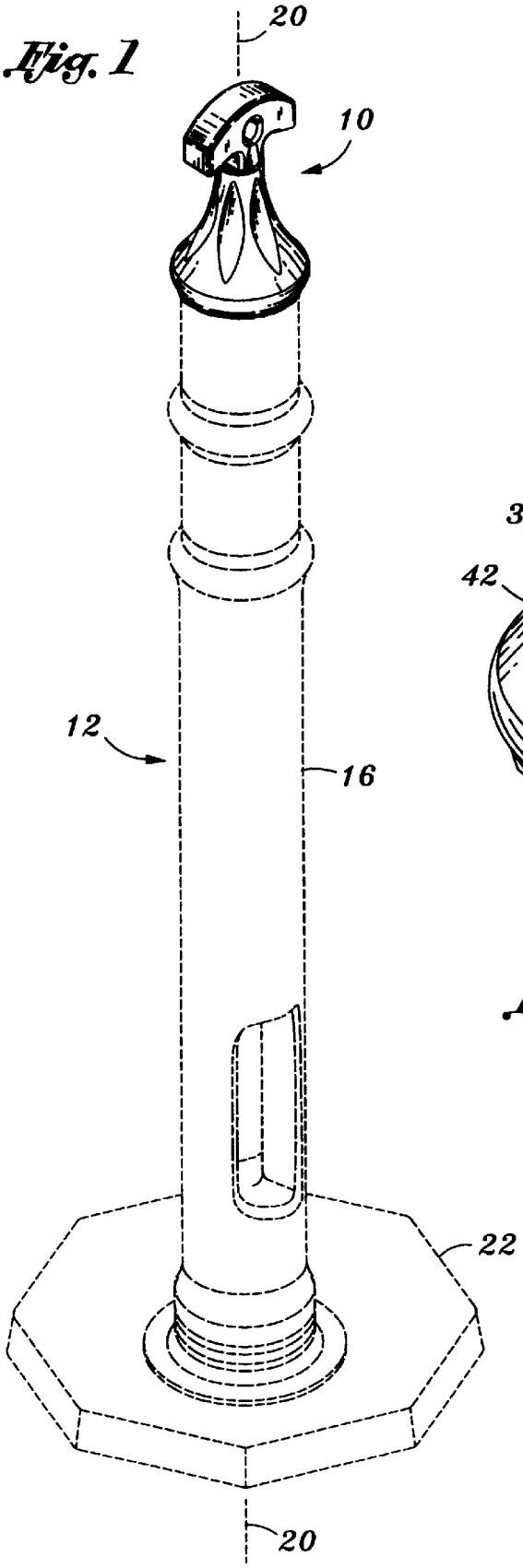
FIG. 1 is a perspective view of a traffic delineator cylinder having a handle according to a first embodiment of the present invention.

As shown in the drawings, the present invention is embodied in a handle 10 for a traffic delineator 12. The handle is formed into the top of a unitary cylinder 16 or cone 18 or many other delineators known in the art. The handle is formed of plastic, typically during the blow molding of the cylinder or cone.

The cylinder 16 or cone 18 comprises a hollow body with a central vertical axis 20 and is preferably formed by blow molding and subsequent trimming. Such delineators are known in the art. The delineator 12 may be made of many shapes and colors, including those most common in the traffic delineation industry. A plastic or rubber base 22 is often mounted on the delineator to provide ballast. Preferably the delineator is interchangeable and, where applicable, stackable, with existing cylinders or cones, and may be used with existing delineator bases. Making the delineator hollow reduces the weight and significantly reduces the amount of material needed. The delineator may be made of any of the materials known in the art, and usually includes pigments for the desired color, ultraviolet light inhibitors, stabilizers and fillers.

Figure 2:
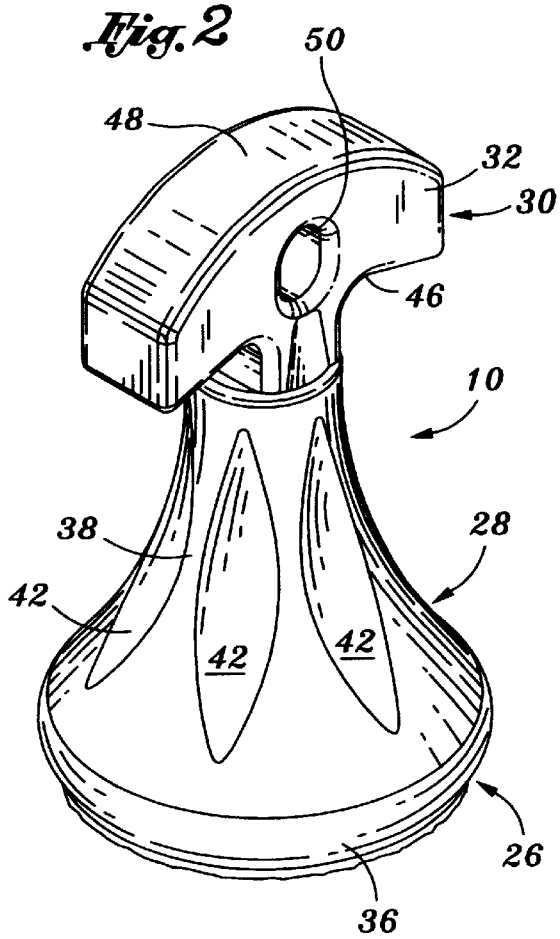
FIG. 2 is a close up perspective view of the handle depicted on the cylinder of FIG. 1.

As depicted in FIGS. 1 and 2, the handle 10 comprises of a convexly curved lower portion 26, a concavely curved intermediate portion 28, and an upper portion 30 that includes a T-shaped grip 32. The shape of the lower portion is preferably that of the outer surface of a toroid. That is, a cross-sectional view of the lower portion has the shape of a generally circular arc having a radius of between about one-half inch and one inch. In the three dimensional lower portion, that arc is rotated 360° about the axis 20 of the cylinder 16 to form the convexedly curved outer wall 36 of the lower portion of the handle 10. In one embodiment, the lower portion has a radius measured from the axis of the cylinder of between about two to three inches and a vertical height of between about one-half and one inches.

The lower portion 26 seamlessly extends into the intermediate portion 28 of the handle 10. The side wall 38 of the intermediate portion of the handle has the shape of a concave curve that has been rotated 360° about the axis 20 of the cylinder 16. Although a parabolic curve, a hyperbolic curve, or other curves could be used to form the intermediate portion, Applicants have found that a generally circular curve having a radius R of between four and five inches best fits the grip of a human hand. Applicants have also found that the intermediate portion should be between about three to five inches in height.

The concave curve of the side wall 38 is oriented at an angle to the axis 20 of the delineator 12. That is, the radius R of the concave curve is not perpendicular to the axis. As a result, the radius of the intermediate portion 28 about the axis of the delineator gradually reduces from between about two to three inches at bottom of the lower portion 26 to between about one to two inches at top of the intermediate portion. This reduction of the radius of the intermediate portion along the concave curvature of the side wall 38 renders the intermediate portion exceedingly easily gripped by a human hand, and it also greatly increases the strength and durability of the handle 12.

As depicted in FIGS. 1–6, according to one embodiment of the present invention, the handle 10 includes curved indentations 42 cut into the side wall 38 of the intermediate portion 28. Such indentations increase the strength of the intermediate portion. However, as depicted in FIGS. 7–12, in other embodiments of the present invention such indentations are not incorporated.

The upper portion 30 of the handle 10 depicted in FIGS. 1–12 has a modified "T" shape grip 32. The "T" shape grip acts as a block so that when a hand grasps the intermediate portion 28 of the handle 10, undercut surfaces 46 of the upper portion contact the hand to assist in lifting the delineator 12. Also, fingers may grasp the undercut surfaces 46 to grab the handle. The crossing surface 48 on top of the handle is preferably formed with a convex arc that facilitates holding the handle in the palm of the hand.

Figure 2A:
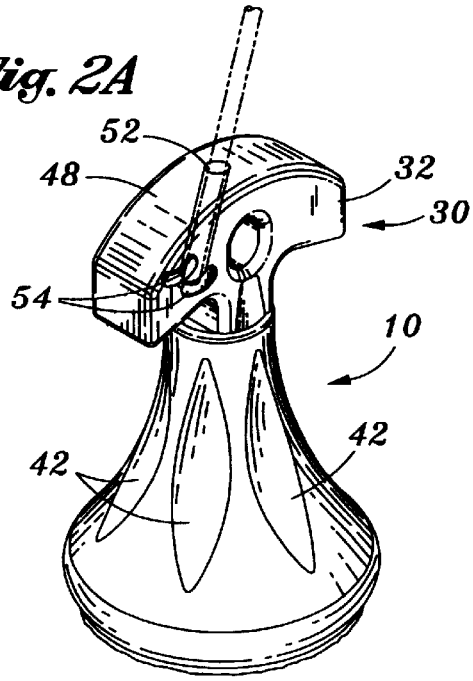
FIG. 2A is a close up perspective view of the handle depicted on the cylinder of FIG. 1 that includes a hole for mounting a flag therein.
Figure 3:
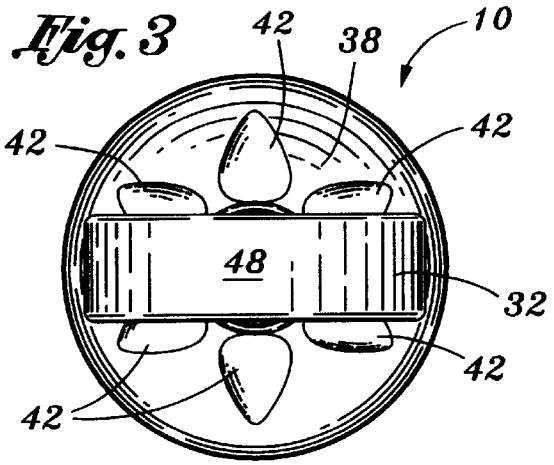
FIG. 3 is a top view of the handle of FIG. 2.
Figure 4:
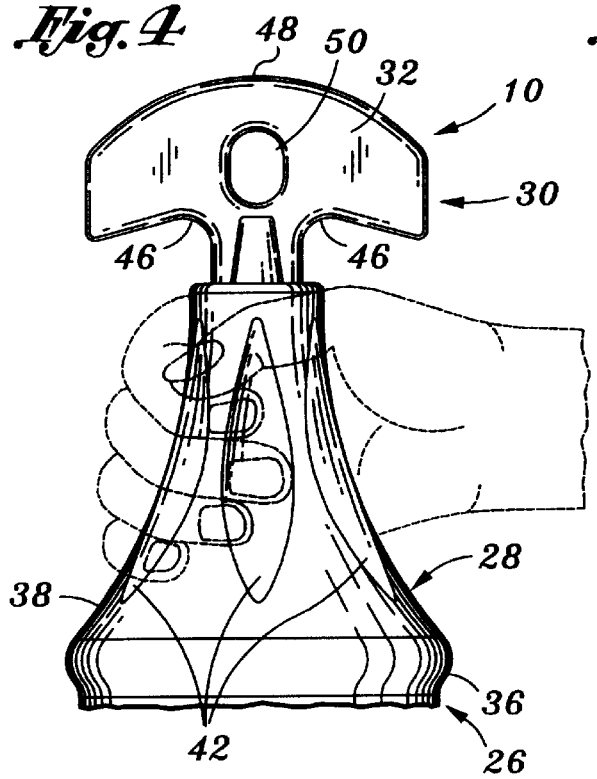
FIG. 4 is a first side view of the handle of FIG. 2.
Figure 5:
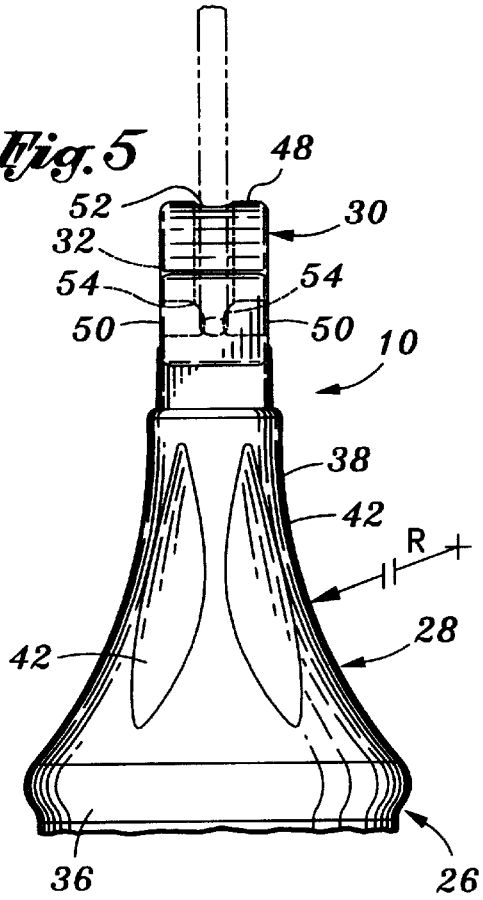
FIG. 5 is a second side view of the handle of FIG. 2.
Figure 6:
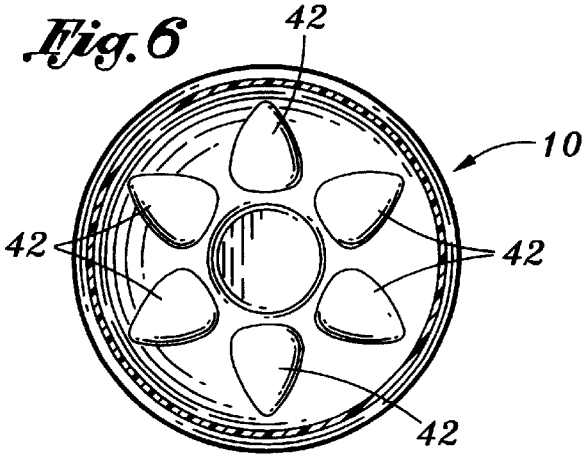
FIG. 6 is a cut-away bottom view of the handle of FIG. 2.
Figure 7:
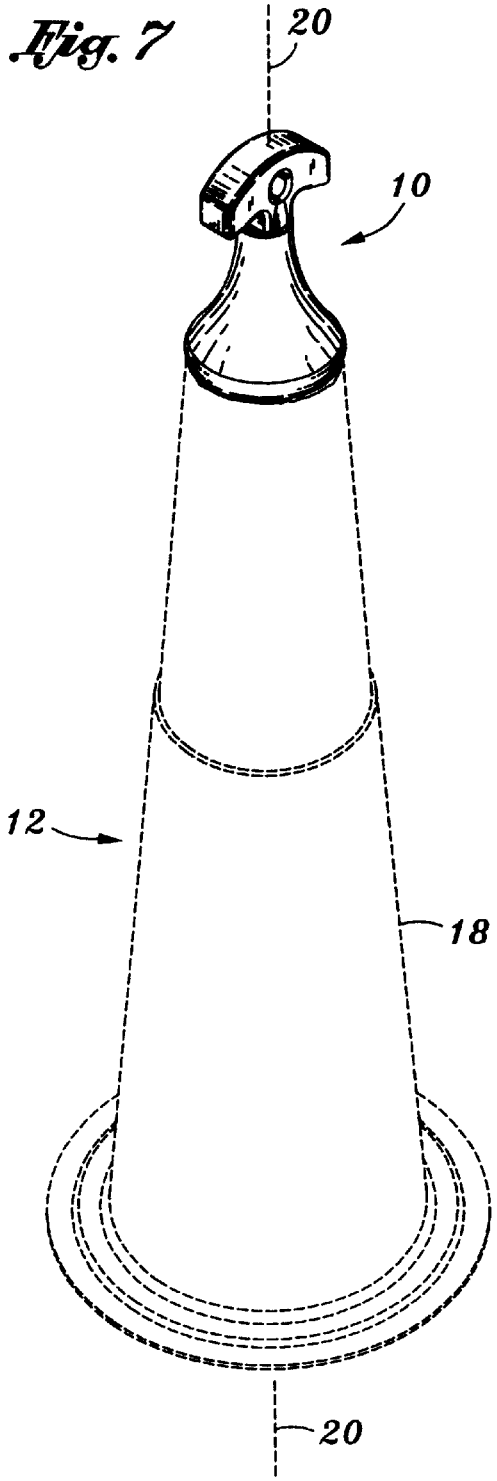
FIG. 7 is a perspective view of a traffic delineator cylinder having a handle according to a second embodiment of the present invention.
Figure 8:
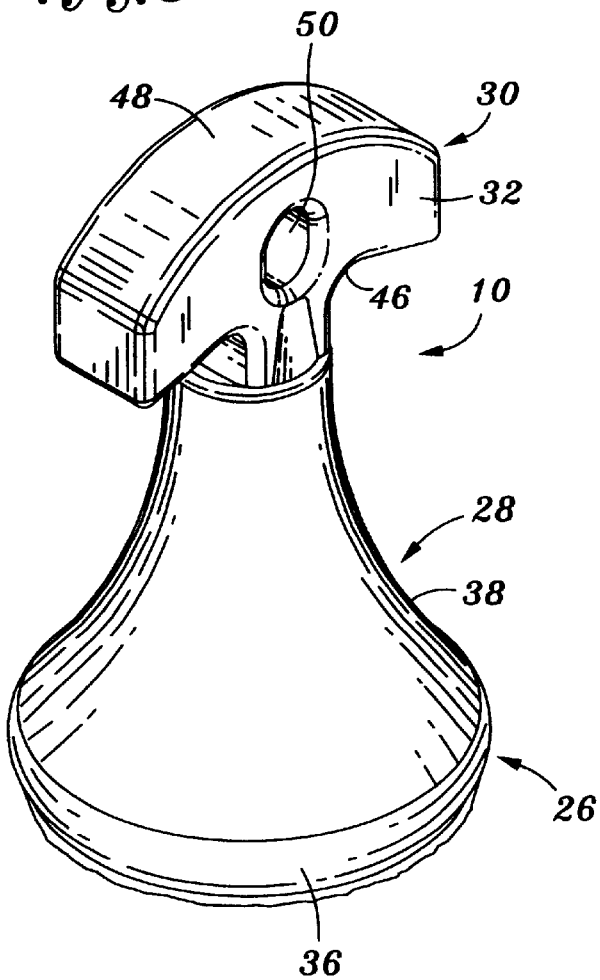
FIG. 8 is a close up perspective view of the handle depicted on the cylinder of FIG. 7.
Figure 9:
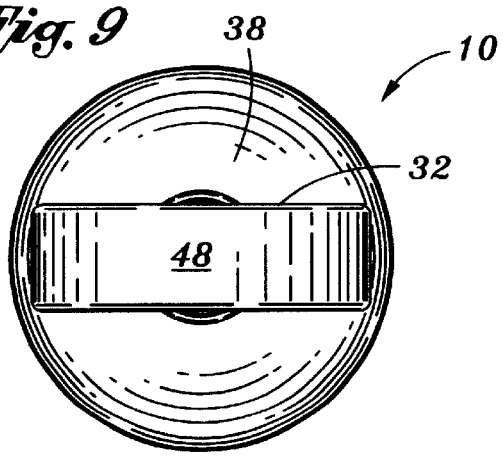
FIG. 9 is a top view of the handle of FIG. 8.
Figure 10:
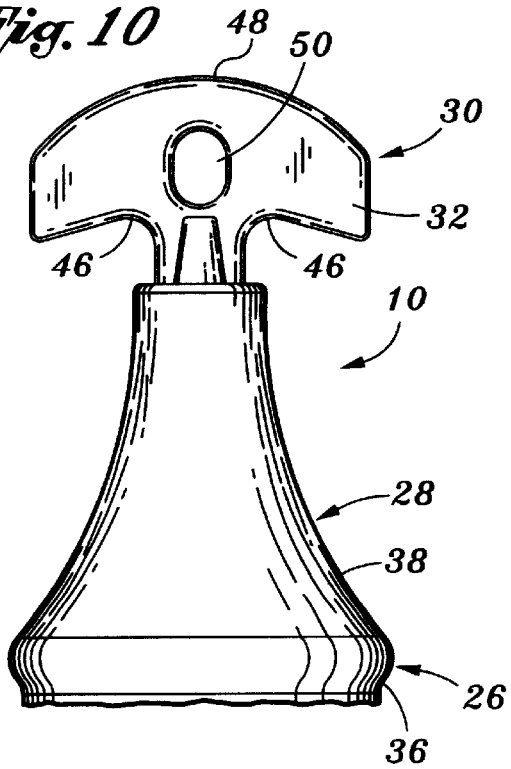
FIG. 10 is a first side view of the handle of FIG. 8.
Figure 11:
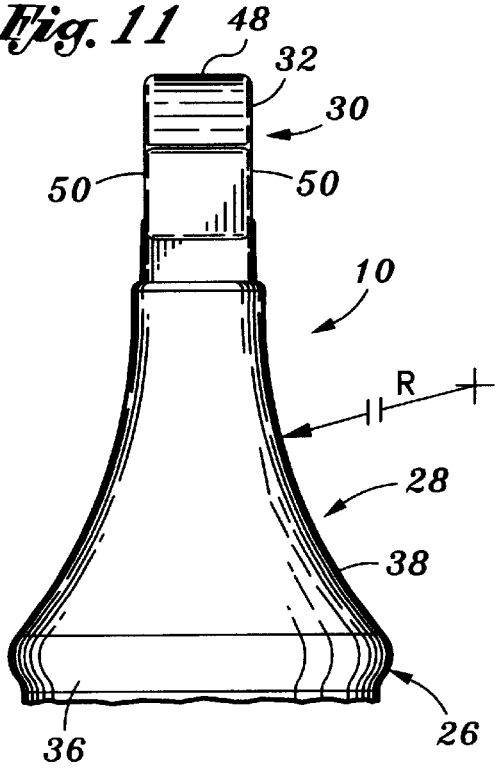
FIG. 11 is a second side view of the handle of FIG. 8.
Figure 12:
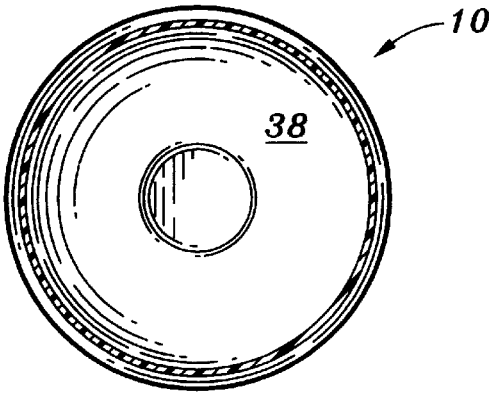
FIG. 12 is a cut-away bottom view of the handle of FIG. 8.

As perhaps best shown in FIGS. 2 and 8, a hole 50 may be formed into the "T" shape grip 32. Such a hole 50 is useful for mounting a light, sign, or other traffic safety device to the delineator 12. The hole may be compression molded into the "T" shape grip, or may be cut out of the grip after molding, preferably by incorporating a divot into the mold where the hole is to be placed. As depicted in FIG. 2A, a bore 52 for accepting a flag pole may also be included on the top of the "T" shape grip. A detent 54 may be formed into the side walls 32 of the upper portion 30 for supporting the flag pole when inserted into the bore.

The "T" shape grip 30 may be replaced by many of the handles of the prior art. For instance, U.S. Pat. No. 5,749,673, the disclosure of which is incorporated herein by this reference, depicts a "baseball bat" style handle that may be incorporated into the present invention. Alternatively, a straight "T" shaped handle or an inverted "U" shaped handle, such as is depicted in U.S. Pat. No. 5,036,791, may be used.

It will be obvious to those of skill in the art that the handles depicted in the FIGURES may be modified produce different embodiments of the present invention. Thus, the present invention has several advantages over the prior art without sacrificing any of the advantages of the prior art. Although two embodiments of the invention have been illustrated and described, various modifications and changes may be made by those skilled in the art without departing from the spirit and scope of the invention.

What is claimed is:

1. A handle integrally formed on a blow-molded traffic delineator that has a vertical axis, the handle being between five and nine inches in height, the handle comprising:

a lower portion attached to the traffic delineator, the lower portion having a vertical height of between one-half and one and one-half inches and having a circular horizontal cross-section, the shape of the lower portion being substantially that of a convex arc with a predetermined radius rotated 360° about the vertical axis of the traffic delineator;

an intermediate portion having a lower end and an upper end, the lower end being integrally formed with the lower portion of the handle, the intermediate portion having a vertical height of between about three and five inches and having a concavely curved side wall, the concavely curved side wall being substantially that of an arc of a predetermined radius rotated about the vertical axis of the traffic delineator, the radius of the arc of the side wall being oblique to the vertical axis of the delineator, which causes the intermediate portion gradually to narrow from a radius of between two and three inches at the lower end to a radius of between one and two inches at the upper end; and an upper portion formed into and abutting the upper end of the concavely curved intermediate portion, the upper portion comprising a horizontal cross bar extending beyond the radius of the upper end of the intermediate portion and spaced in close proximity to the upper end of the intermediate portion, and a means for supporting a warning light on the traffic delineator.

2. The handle of claim 1 further comprising a plurality of scalloped indentations formed in the side wall of the intermediate portion.

3. The handle of claim 1 further comprising a detent for supporting a flag.

4. A handle integrally formed on a blow-molded traffic delineator that has a vertical axis, the handle comprising:

a lower portion attached to the traffic delineator, the lower portion having an outer surface substantially formed from a convexly curved arc with a predetermined radius rotated 360° about the vertical axis of the traffic delineator;

an intermediate portion having a lower end and an upper end, the lower end being integrally formed with the lower portion of the handle, the intermediate portion having a side wall substantially formed from a concavely curved arc of a predetermined radius rotated about the vertical axis of the traffic delineator, the radius of the concavely curved arc being oblique to the vertical axis of the delineator to cause the intermediate portion gradually to narrow moving from the lower end to the upper end; and an upper portion formed into and abutting the upper end of the concavely curved intermediate portion, the upper portion comprising a horizontal cross bar spaced in close proximity to the upper end of the intermediate portion and a means for supporting a warning light on the traffic delineator.

5. The handle of claim 4 wherein the intermediate portion gradually narrows from a radius of between two and three inches at the lower end to a radius of between one and two inches at the upper end.

6. The handle of claim 4 further comprising a plurality of scalloped indentations formed in the side wall of the intermediate portion.

7. The handle of claim 4 further comprising a detent for supporting a flag post that has been inserted into the handle.

8. A handle integrally formed on a blow-molded traffic delineator that has a vertical axis, the handle comprising:

a means connecting the handle to the delineator;

an intermediate portion having a side wall substantially formed from a concavely curved arc of a predetermined radius rotated about the vertical axis of the traffic delineator, the radius of the concavely curved arc being oblique to the vertical axis of the delineator to cause the intermediate portion gradually to narrow moving up the vertical axis of the traffic delineator; and an upper portion abutting the upper end of the concavely curved intermediate portion, the upper portion comprising a horizontal cross bar spaced in close proximity to the upper end of the intermediate portion.

9. The handle of claim 8 wherein the intermediate portion gradually narrows from a radius of between two and three inches to a radius of between one and two inches.

10. The handle of claim 8 further comprising a lower portion formed beneath the intermediate portion, the lower portion comprising an outer surface substantially formed from a convexly curved arc with a predetermined radius rotated 360° about the vertical axis of the traffic delineator.

11. The handle of claim 8 further comprising a plurality of scalloped indentations formed in the side wall of the intermediate portion.

12. The handle of claim 8 further comprising means for mounting a traffic warning light thereon.

13. The handle of claim 8 further comprising a detent for supporting a flag post that has been inserted into the handle.

* * * * *